United States Patent [19]

Uranishi et al.

[11] Patent Number: 4,838,229

[45] Date of Patent: Jun. 13, 1989

[54] AIR-FUEL RATIO CONTROL DEVICE OF AN INTERNAL COMBUSTION ENGINE

[75] Inventors: Kouji Uranishi, Susono; Takaaki Itou, Mishima, both of Japan

[73] Assignee: Toyota Jidosha Kabushiki Kaisha, Toyota, Japan

[21] Appl. No.: 177,289

[22] Filed: Apr. 1, 1988

[30] Foreign Application Priority Data

Apr. 8, 1987 [JP] Japan ..... 62-084862

[51] Int. Cl.[4] ..... F02D 41/22; F02M 7/24; F02M 25/08

[52] U.S. Cl. ..... 123/440; 123/489; 123/520; 123/589

[58] Field of Search ..... 123/440, 489, 519, 520, 123/589, 439

[56] References Cited

U.S. PATENT DOCUMENTS 4,638,840 1/1987 Saito et al. ..... 123/489
4,641,623 2/1987 Hamburg ..... 123/440 X
4,763,634 8/1988 Morozumi ..... 123/520

FOREIGN PATENT DOCUMENTS 1857 1/1986 Japan ..... 123/520

*Primary Examiner*—Tony M. Argenbright
*Attorney, Agent, or Firm*—Cushman, Darby & Cushman

[57] ABSTRACT

An air-fuel ratio control device comprising an electric air bleed control valve which controls the amount of air fed into the fuel passage of the carburetor so that an air-fuel ratio becomes equal to the stoichiometric air-fuel ratio. The degree of opening of the air bleed control valve is increased as electric current fed into the air bleed control valve is increased. Fuel vapor is fed into the intake passage from the canister via a purge control valve. When the purge control valve is opened, and the rate of increase in the amount of current fed into the air bleed control valve exceeds a fixed rate, the current fed into the air bleed control valve is instantaneously increased by a fixed amount.

11 Claims, 6 Drawing Sheets

AIR-FUEL RATIO CONTROL DEVICE OF AN INTERNAL COMBUSTION ENGINE

BACKGROUND OF THE INVENTION

1. Field of the Invention

The present invention relates to an air-fuel ratio control device of an internal combustion engine.

2. Description of the Related Art

An internal combustion engine is known, which comprises an electric purge control:valve for controlling the supply of purge gas fed into the intake passage of an engine from a charcoal canister, and an electric air bleed control valve for controlling the amount of air fed into the fuel passage of a carburetor. An electric current fed into the air bleed control valve is controlled on the basis of the output signal of an oxygen concentration detecting sensor (hereinafter referred to as an $O_2$ sensor) arranged in the exhaust passage of the engine so that the amount of air fed into the fuel passage of the carburetor is increased as the amount of electric current fed into the air bleed control valve is increased (Japanese Unexamined Patent Publication No. 61-1857). In this engine, when the purge control valve is opened, and thus the supply of the purge gas is started, if the purge gas contains a large fuel component, an air-fuel mixture fed into the engine cylinders becomes extremely rich. As a result, the amount of electric current fed into the air bleed control valve is gradually increased so that an air-fuel ratio approaches the stoichiometric air-fuel ratio, and accordingly, the amount of air fed into the fuel passage of the carburetor is gradually increased. Subsequently, when the electric current fed into the air bleed control valve is increased to the maximum level of the controllable range, an air-fuel ratio control is changed from the air-fuel ratio control based on the air bleed control to the air-fuel ratio control based on the purge control, and thus the amount of purge gas is controlled so that an air-fuel ratio approaches the stoichiometric air-fuel ratio.

However, actually, when the supply of purge gas is started, the electric current fed into the air bleed control valve normally does not reach the maximum level of the controllable range, and thus, at this time, the amount of air fed into the fuel passage of the carburetor from the air bleed passage is gradually increased until the air-fuel ratio of air-fuel mixture fed into the engine cylinders becomes equal to the stoichiometric air-fuel ratio. However, if the amount of air fed from the air bleed passage is gradually increased as mentioned above, it takes a long time to equalize the air-fuel ratio with the stoichiometric air-fuel ratio. Consequently, since an extremely rich air-fuel mixture is still fed into the engine cylinders for a long time, a problem occurs in that a large amount of unburned HC and CO is discharged from the engine cylinders during that time.

SUMMARY OF THE INVENTION

An object of the present invention is to provide an air-fuel ratio control device capable of reducing the amount of unburned HC and CO discharged from the engine cylinders by shortening the time during which the air-fuel mixture is extremely rich after the supply of purge gas is started.

According to the present invention, there is provided an internal combustion engine having at least one cylinder, an intake passage and an exhaust passage, the engine comprising: a carburetor arranged in the intake passage and having a fuel passage which is open to the intake passage; an electric air-fuel ratio control valve controlling an air-fuel ratio of an air-fuel mixture fed into the cylinder in response to an electric control signal, the air-fuel ratio of the air-fuel mixture increasing as a level of the electric control signal rises; an oxygen concentration detector arranged in the exhaust passage to produce a lean signal when the air-fuel ratio of the air-fuel mixture fed into the cylinder is larger than a predetermined air-fuel ratio and to produce a rich signal when the air-fuel ratio of the air-fuel mixture is smaller than the predetermined air-fuel ratio; first control means controlling the level of the electric control signal in response to the lean signal and the rich signal to raise the level of the electric control signal when the rich signal is produced and lower the level of the electric control signal when the lean signal is produced; a charcoal canister containing activated carbon; a purge control valve arranged between the charcoal canister and the intake passage to control the supply of purge gas fed into the intake passage from the charcoal canister; and second control means controlling the level of the electric control signal in response to both a rate of rising of the level of the control signal and an opening operation the purge control valve to instantaneously increase the level of the electric control signal by a predetermined level when the rate of increase exceeds a predetermined rate and when said purge control valve is open.

The present invention may be more fully understood from the description of a preferred embodiment of the invention set forth below, together with the accompanying drawings.

BRIEF DESCRIPTION OF THE DRAWINGS

In the drawings:

FIGS. 3, 3A and 3B are a flow chart for executing the control of an air-fuel ratio;

DESCRIPTION OF THE PREFERRED EMBODIMENT

Figure 1:
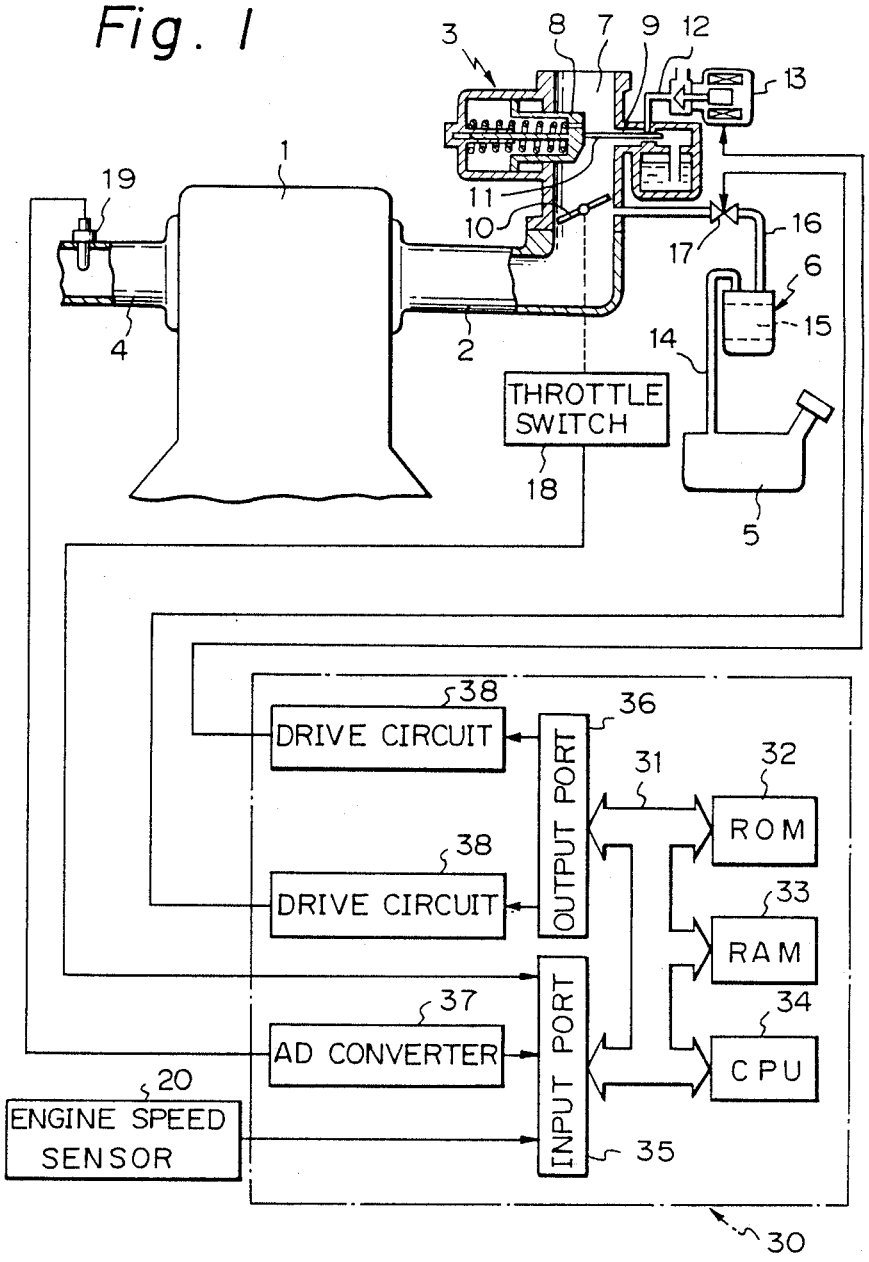
FIG. 1 is a schematically illustrated view of an engine.

Referring to FIG. 1, reference numeral 1 designates an engine body, 2 an intake manifold, 3 a variable venturi type carburetor, and 4 an exhaust manifold; 5 designates a fuel tank, and 6 a charcoal canister containing activated carbon. The variable venturi type carburetor 3 comprises an intake passage 7, a suction piston 8, a fuel passage 9 which is open to the intake passage 7, and a throttle valve 10. The amount of fuel fed into the intake passage 7 from the fuel passage 9 is controlled by a needle 11 mounted on the suction piston 8. An air bleed passage 12 is connected to the fuel passage 9, and an air bleed control valve 13 is arranged in the air bleed passage 12. This air bleed control valve 13 is controlled on the basis of a control current output from an electronic control unit 30. When the control current fed into the air bleed control valve 13 is increased, the amount of air fed into the fuel passage 9 from the air bleed passage 12 is increased, and thus the air-fuel mixture fed into the engine cylinders becomes lean. Conversely, when the control current fed into the air bleed control valve 13 is reduced, the amount of air fed into the fuel passage 9 from the air bleed passage 12 is reduced, and thus the air-fuel mixture fed into the engine cylinders becomes rich.

The fuel tank 5 is connected to the charcoal canister 6 via a fuel vapor conduit 14, and fuel vapor produced in the fuel tank 5 is adsorbed by the activated carbon 15 in the canister 6. In addition, the canister 6 is connected via a purge conduit 16 to the intake passage 7 downstream of the throttle valve 10, and a purge control valve 17 is arranged in the purge conduit 16. When the purge control valve 17 is opened, fuel adsorbed in the activated carbon 15 is desorped therefrom, and thus fuel vapor is fed into the intake passage 7 from the purge conduit 16.

The electronic control unit 30 is constructed as a digital computer and comprises a ROM (read only memory) 32, a RAM (random access memory) 33, a CPU (microprocessor, etc.) 34, an input port 35, and an output port 36. The ROM 32, the RAM 33, the CPU 34, the input port 35, and the output port 36 are interconnected via a bidirectional bus 31. A throttle switch 18 detecting an idling opening degree of the throttle valve 10 is attached to the throttle valve 10, and the output signal of the throttle switch 18 is input to the input port 35. An $O_2$ sensor 19 is arranged in the exhaust manifold 4, and the output signal of the $O_2$ sensor 19 is input to the input port 35 via an AD converter 37. In addition, an engine speed sensor 20 producing output pulses having a frequency proportional to the engine speed is connected to the input port 35. The output port 36 is connected to the air bleed control valve 13 and the purge control valve 17 via corresponding drive circuits 38.

An air-fuel ratio control according to the present invention will be hereinafter described with reference to FIGS. 2 through 5.

Figure 4:
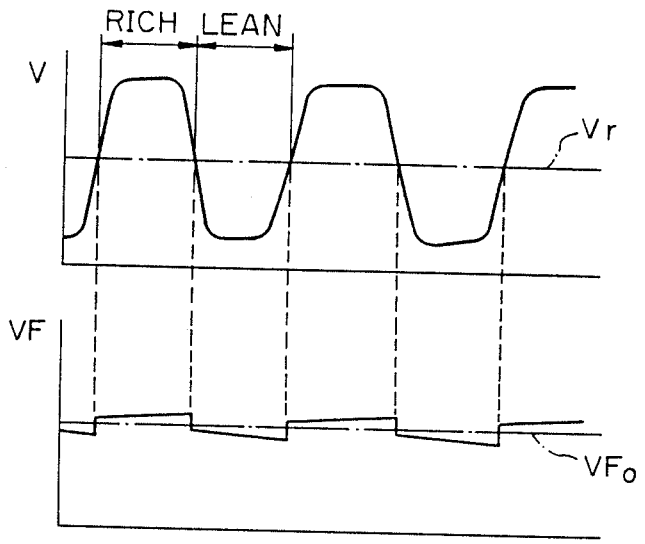
FIG. 4 is a diagram illustrating the output signal of the $O_2$ sensor and the control current VF.

FIG. 4 illustrates changes in the output voltage V of the $O_2$ sensor 19. The $O_2$ sensor 19 produces the output voltage V of about 0.9 volt when the air-fuel mixture is rich, and produces the output voltage V of about 0.1 volt when the air-fuel mixture is lean. The output voltage V of the $O_2$ sensor 19 is compared with a reference voltage Vr of about 0.45 volt in the CPU 34. At this time, if the output voltage V of the $O_2$ sensor 19 is higher than Vr, the air-fuel mixture is considered rich, and if the output voltage V of the $O_2$ sensor 19 is lower than Vr, the air-fuel mixture is considered lean.

Figure 2:
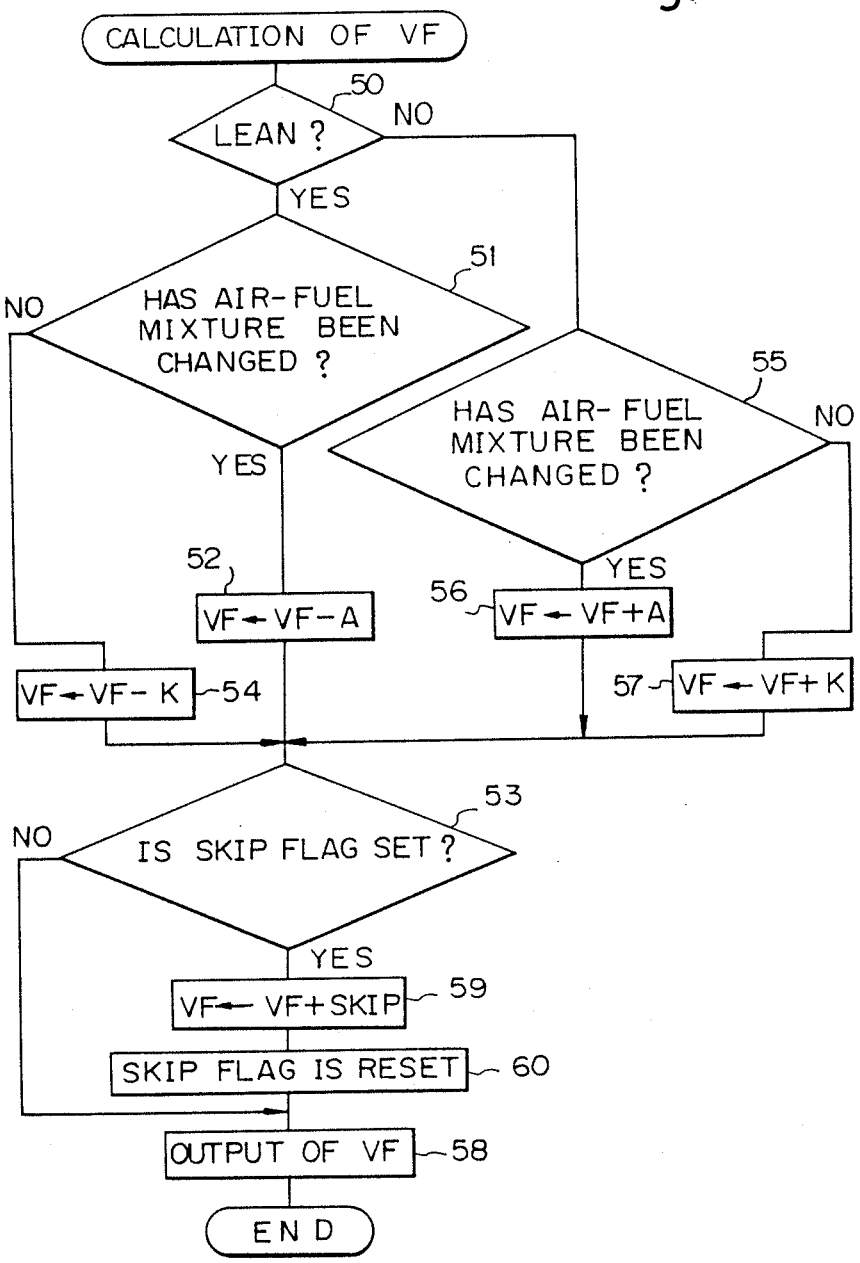
FIG. 2 is a flow chart for executing the calculation of the control current VF.

FIG. 2 illustrates a routine for the calculation of the control current VF of the air bleed control valve 13, which calculation is carried out on the basis of a determination of whether the air-fuel mixture is rich or lean.

Referring to FIG. 2, in step 50, it is determined whether or not the air-fuel mixture is lean. When the air-fuel mixture is lean, the routine goes to step 51, and it is determined whether the air-fuel mixture has been changed from rich to lean after completion of the preceding processing cycle. When the air-fuel mixture has been changed from rich to lean, the routine goes to step 52, and a skip value A is subtracted from VF. Then, the routine goes to step 53. When the air-fuel mixture has not been changed from rich to lean after completion of the preceding processing cycle, the routine goes to step 54, and an integration value K(K<A) is subtracted from VF. Then, the routine goes to step 53.

When it is determined in step 50 that the air-fuel mixture is rich, the routine goes to step 55, and it is determined whether the air-fuel mixture has been changed from lean to rich after completion of the preceding processing cycle. When the air-fuel mixture has been changed from lean to rich, the routine goes to step 56, and the skip value A is added to VF. Then, the routine goes to step 53. When the air-fuel mixture has not been changed from lean to rich after completion of the preceding processing cycle, the routine goes to step 57, and the integration value K is added to VF. Then, the routine goes to step 53. In step 53, it is determined whether a skip flag indicating that VF is to be increased by a fixed value is set. Since this skip flag is normally reset, the routine jumps to step 58, and VF is output to the output port 3.

Consequently, as illustrated in FIG. 4, when the air-fuel mixture is changed from rich to lean, the value of VF is abruptly reduced by the skip value A and then gradually reduced. Conversely, when the air-fuel mixture is changed from lean to rich, the value of VF is abruptly increased by the skip value A and then gradually increased. The value of VF calculated in each step 52, 54, 56, 57 and output to the output port 36 in step 58 in FIG. 2 represents a duty cycle of pulse, and the serial pulses which are produced at a fixed frequency and have a pulse width changed in accordance with the duty cycle are fed into the air bleed control valve 13. The opening degree of the air bleed control valve 13 is controlled in response to the mean value of current of the serial pulses and, therefore, VF is called the control current of the air bleed control valve 13. As illustrated in FIG. 4, this control current VF normally moves up and down around a reference value $VF_0$.

Turning to FIG. 2, when it is determined in step 53 that the skip flag is set, the routine goes to step 59, and a fixed value SKIP is added to VF. Then, in step 60, the skip flag is reset.

Figure 5:
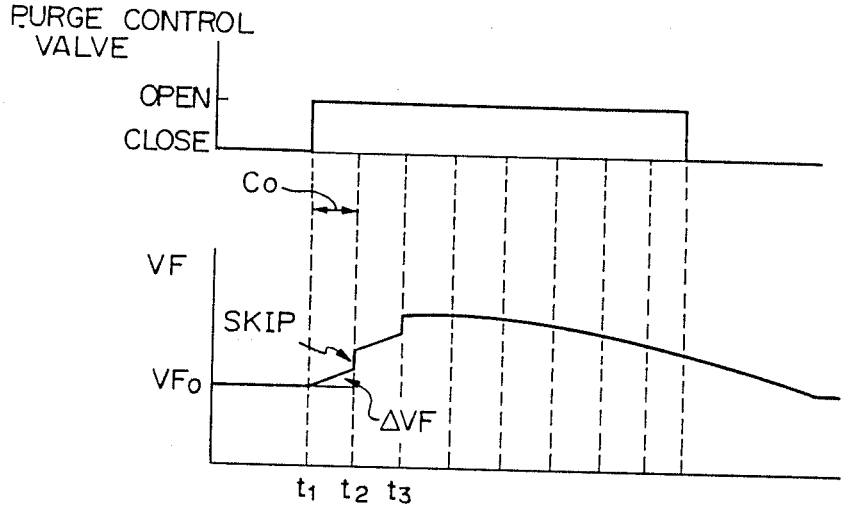
FIG. 5 is a diagram illustrating the control current VF and the opening operation of the purge control valve.

FIG. 5 illustrates the opening of the purge control valve 17 and changes in the mean value of VF. As illustrated in FIG. 5, before the time $t_1$, that is, when the purge control valve 17 is closed, the mean value of VF is held at approximately the reference value $VF_0$. Then, if the purge control valve 17 is opened at the time $t_1$, and thus the purge gas containing a large amount of fuel component therein is fed into the intake passage 7, since the air-fuel mixture fed into the engine cylinders becomes excessively rich, the control current VF increases, as illustrated in FIG. 5. At this time, if the rate of increase in the control current VF exceeds a fixed rate, that is, if an increase $\Delta VF$ of the control current VF per a fixed time $C_0$ exceeds a predetermined fixed value, the control current VF is instantaneously increased by a fixed value SKIP at the time $t_2$. After this, if the rate of increase in the control current VF again exceeds the fixed rate, the control current VF is again instantaneously increased by the fixed value SKIP. That is, the control current VF is instantaneously increased by the fixed value SKIP each time the control current VF is increased by more than the fixed value $\Delta VF$ during the elapse of a time $C_0$. This fixed value SKIP is considerably larger than the skip value A in steps 52 and 56 of FIG. 2. In the present invention, as mentioned above, when the supply of purge gas is started, and the air-fuel mixture then becomes extremely rich, since the control current VF is rapidly increased until the air-fuel ratio becomes approximately equal to the stoichiometric air-fuel ratio, it is possible to shorten the length of time during which the air-fuel mixture is in an extremely rich state, and thus it becomes possible to reduce the amount of unburned HC and CO discharged from the engine cylinders.

Figure 3A:
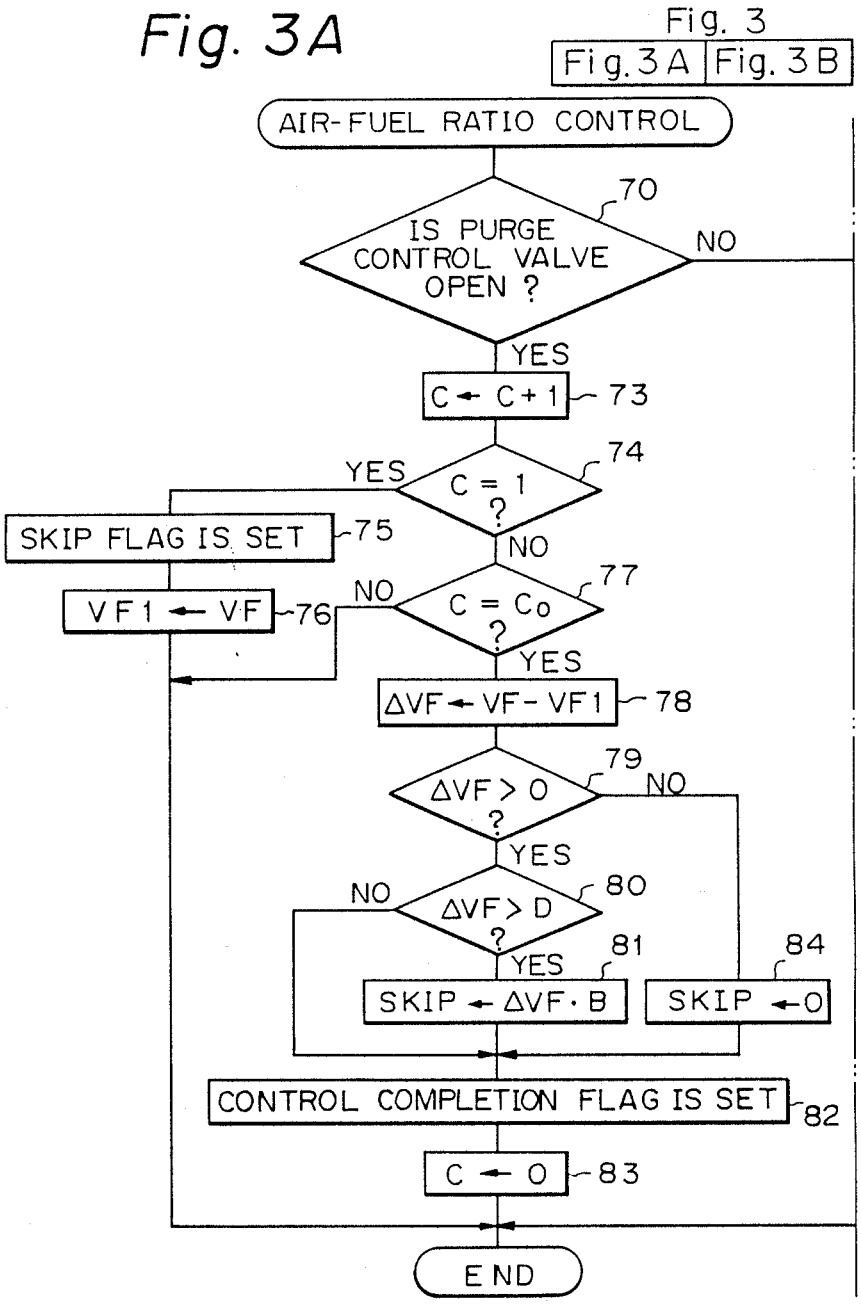
Figure 3B:
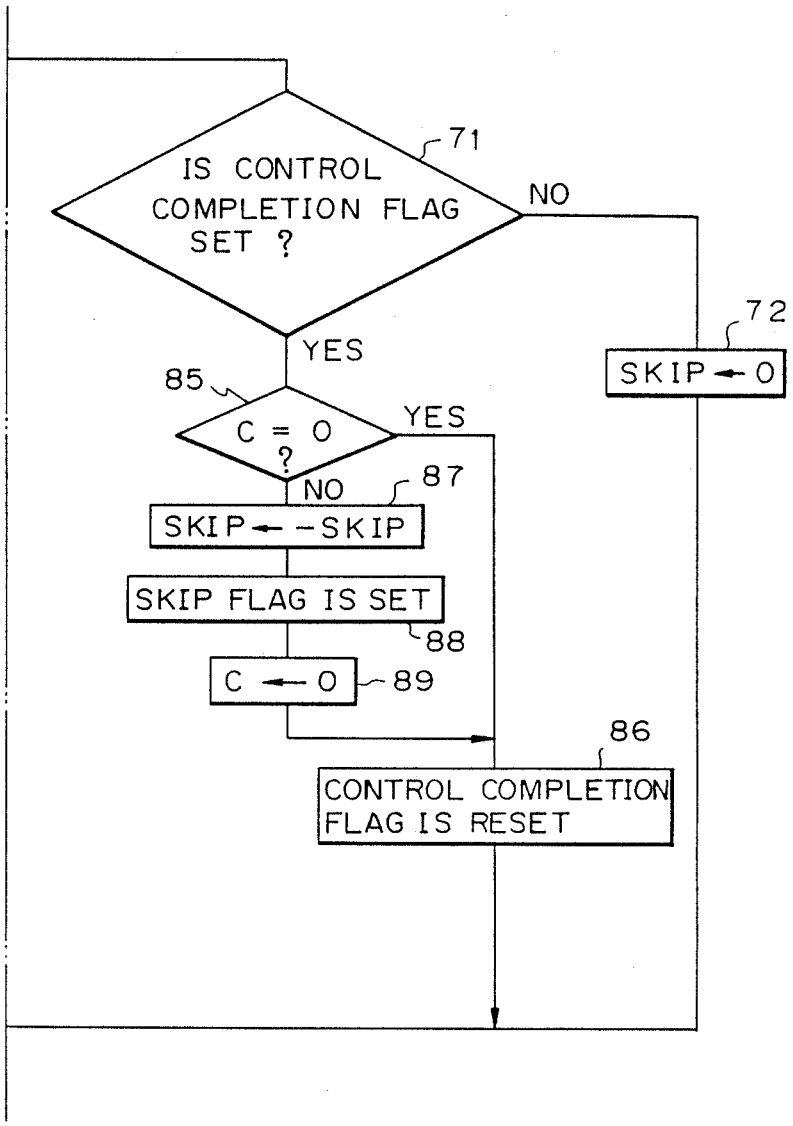

FIG. 3 illustrates a flow chart for executing the air-fuel ratio control illustrated in FIG. 5. The routine illustrated in FIG. 3 is processed by sequential interruptions which are executed at predetermined intervals.

Referring to FIG. 3, in step 70, it is determined whether the purge control valve 17 is open. This purge control valve 17 is closed, for example, when the engine is operating in an idling state, and the purge control valve 17 is open when the throttle valve 10 is open. When the purge control valve 17 is closed, the routine goes to step 71, and it is determined whether a control completion flag indicating that the control of increasing VF by the fixed value SKIP is completed is set. If the supply of purge gas has not been carried out, since the control completion flag is reset, the routine goes to step 72, and the fixed value SKIP becomes equal to zero. Then, the processing cycle is completed.

If the purge control valve 17 is opened, the routine goes to step 73 from step 70, and the count value C is incremented by one. When the air-fuel ratio control is started, the counter is cleared. Consequently, when the routine goes to step 73 for the first time, the count value C becomes equal to 1. Then, in step 74, it is determined whether the count value C is equal to 1. At this time, since the count value C is equal to 1, the routine goes to step 75, and the skip flag is set. If the skip flag is set, the fixed value SKIP is added to the control current VF in step 59 of FIG. 2. However, at this time, since the fixed value SKIP is equal to zero, the actual control current VF remains unchanged. Then, in step 76 of FIG. 3, the control current VF is memorized as VF1, and the processing cycle is completed.

In the next processing cycle, the routine goes to step 77 from 70 via steps 73 and 74, and it is determined whether the count value C is equal to a fixed value $C_0$, that is, whether a fixed time has elapsed after the purge control valve 17 is opened. If the count value C is not equal to the fixed value $C_0$, the processing cycle is completed. Conversely, if the count value C is equal to the fixed value $C_0$, the routine goes to step 78. In step 78, VF1, that is, the control current VF at the time of $C=1$ is subtracted from the present control current VF, and the result of the subtraction is memorized as $\Delta VF$. Consequently, this $\Delta VF$ indicates the amount of change in the control current VF, which change occurs during the elapse of the fixed time $C_0$. Then, in step 79, it is determined whether $\Delta VF$ is positive. If $\Delta VF>0$, it is determined in step 80 whether $\Delta VF$ is larger than a fixed value D. If $\Delta VF>D$, $\Delta VF$ is multiplied by a fixed value B in step 81, and the result of the multiplication is memorized as SKIP. Consequently, the value of SKIP becomes large as $\Delta VF$ becomes large. After this, in step 82, the control completion flag is set, and then, in step 83, the counter is cleared.

Conversely, when it is determined in step 79 that $\Delta VF$ is equal to or smaller than zero, the routine goes to step 84, and the fixed value SKIP becomes equal to zero. In addition, when it is determined in step 80 that $\Delta VF$ is equal to or smaller than the fixed value D, the routine jumps to step 82. Consequently, at this time, the fixed value SKIP remains unchanged.

Since the counter is cleared in step 83, the routine goes to step 75 from step 70 via steps 73 and 74 in the next processing cycle and, in step 75, the skip flag is set. As a result, in step 59 of FIG. 2, the fixed value SKIP is added to the control current VF. That is, if $\Delta VF>D$, $\Delta VF \cdot B$ is added to the control current VF and, therefore, the control current VF is instantaneously increased by a fixed valve proportional to $\Delta VF$. Conversely, if $\Delta VF \leqq 0$, or if $\Delta VF$ has not become larger than the fixed value D after the purge control valve 17 is opened, since the fixed value SKIP is equal to zero, the instantaneous increase operation of the control current VF is not carried out. The above-mentioned control of the control current VF is carried out at each elapse of the fixed time $C_0$ as long as the purge control valve 17 is open. In this control of the control current VF, if $D \geqq \Delta VF > 0$, the fixed value SKIP, which has been once used, is used again.

If the purge control valve 17 is closed, the routine goes to step 71 from step 70. At this time, since the control completion flag is set, the routine goes to step 85, and it is determined whether the count value C is equal to zero. If $C=0$, the routine jumps to step 86, and the control completion flag is reset. Conversely, if $C \neq 0$, the routine goes to step 87, and— SKIP is memorized as SKIP. Then, in step 88, the skip flag is set. Consequently, in this case, the fixed value SKIP is subtracted from the control current VF. That is, when the purge control valve 17 is closed immediately after the control valve VF is instantaneously increased by the fixed value SKIP, the fixed value SKIP is subtracted from the control current VF to prevent an excessive increase in the control current VF. Then, in step 89, the counter is cleared.

Figure 6:
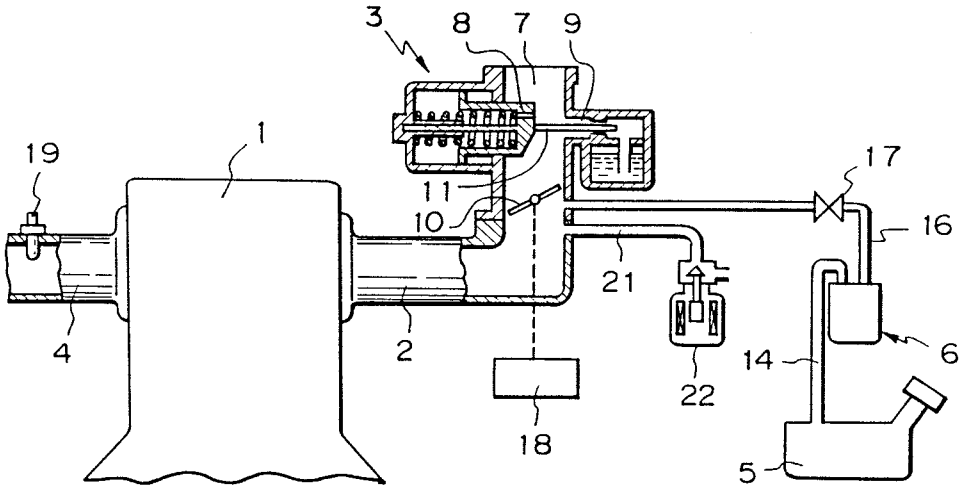
FIG. 6 is a schematically illustrated view of an alternative embodiment of an engine.

FIG. 6 illustrates an alternative embodiment of this invention. In this embodiment, an air supply passage 21 is connected to the intake passage 7 downstream of the throttle valve 10, and an air control valve 22 is arranged in the air supply passage 21. This air control valve 22 is controlled on the basis of a control current output from the electronic control unit 30 (FIG. 1). When the control current fed into the air control valve 22 is increased, the amount of air fed into the intake passage 7 from the air supply passage 21 is increased, and thus the air-fuel mixture fed into the engine cylinders becomes lean. Conversely, when the control current fed into the air control valve 22 is reduced, the amount of air fed into the intake passage 7 from the air supply passage 21 is reduced, and thus the air-fuel mixture fed into the engine cylinders becomes rich.

In this embodiment, the electric control current VF of the air control valve 22 is controlled on the basis of the routine illustrated in FIG. 2. Consequently, as illustrated in FIG. 4, when the air-fuel mixture is changed from rich to lean, the value of VF is abruptly reduced by the skip value A and then gradually further reduced. Conversely, when the air-fuel mixture is changed from lean to rich, the value of VF is abruptly increased by the skip value A and then gradually further increased. Also in this embodiment, the control current VF normally moves up and down around a reference value $VF_0$.

In this embodiment, when the purge control valve 17 is closed, the mean value of VF is held at approximately the reference value $VF_0$. Then, if the purge control valve 17 is opened, and thus the purge gas containing a large amount of fuel component therein is fed into the intake passage 7, since the air-fuel mixture fed into the engine cylinders becomes excessively rich, the control current VF increases. At this time, if the rate of increase in the control current VF exceeds a fixed rate, the control current VF is instantaneously increased by a fixed value SKIP. After this, if the rate of increase in the control current VF again exceeds the fixed rate, the control current VF is again instantaneously increased by the fixed value SKIP.

Consequently, in this embodiment, when the supply of purge gas is started, and the air-fuel mixture then becomes extremely rich, since the control current VF is rapidly increased until the air-fuel ratio becomes approximately equal to the stoichiometric air-fuel ratio, it is possible to shorten the length of time during which the air-fuel mixture is in an extremely rich state, and thus it becomes possible to reduce the amount of unburned HC and CO discharged from the engine cylinders.

According to the present invention, when the supply of purge gas is started, and the air-fuel mixture fed into the engine cylinders becomes excessively rich, the control current VF is rapidly increased until an air-fuel ratio approaches the stoichiometric air-fuel ratio. Consequently, since it is possible to shorten the length of time during which the air-fuel mixture is extremely rich, it becomes possible to reduce the amount of HC and CO discharged from the engine cylinders.

While the invention has been described by reference to specific embodiments chosen for purposes of illustration, it should be apparent that numerous modifications could be made thereto by those skilled in the art without departing from the basic concept and scope of the invention.

We claim:

1. An internal combustion engine having at least one cylinder, an intake passage and an exhaust passage, said engine comprising:

a carburetor arranged in the intake passage and having a fuel passage which is open to the intake passage;

an electric air-fuel ratio control valve controlling an air-fuel ratio of an air-fuel mixture fed into the cylinder in response to an electric control signal, said air-fuel ratio of the air-fuel mixture increasing as a level of said electric control signal rises;

an oxygen concentration detector arranged in the exhaust passage to produce a lean signal when said air-fuel ratio of air-fuel mixture fed into the cylinder is larger than a predetermined air-fuel ratio and to produce a rich signal when said air-fuel ratio of air-fuel mixture is smaller than the predetermined air-fuel ratio;

first control means controlling the level of said electric control signal in response to said lean signal and said rich signal to raise the level of said electric control signal when said rich signal is produced and lower the level of said electric control signal when said lean signal is produced;

a charcoal canister containing activated carbon therein;

a purge control valve arranged between said charcoal canister and the intake passage to control the supply of purge gas fed into the intake passage from said charcoal canister; and second control means controlling the level of said electric control signal in response to both a rate of rising of the level of said electric control signal and an opening operation of said purge control valve to instantaneously raise the level of said electric control signal by a predetermined level when said rate of rising exceeds a predetermined rate and when said purge control valve is open.

2. An internal combustion engine according to claim 1, wherein said electric control signal is represented by an electric current.

3. An internal combustion engine according to claim 1, wherein said predetermined air-fuel ratio is the stoichiometric air-fuel ratio.

4. An internal combustion engine according to claim 1, wherein said purge control valve is closed when the engine is operating in an idling state.

5. An internal combustion engine according to claim 1, wherein said rate of rising is defined by the amount of change in the level of said electric control signal, which change occurs during a fixed time.

6. An internal combustion engine according to claim 1, wherein said predetermined level is proportional to said rate of rising.

7. An internal combustion engine according to claim 1, wherein said predetermined level remains unchanged when said rate of rising is lower than said predetermined rate.

8. An internal combustion engine according to claim 7, wherein said second control means stops the instantaneous increase operation of the level of said electric control current when said rate of rising is lower than zero.

9. An internal combustion engine according to claim 1, wherein said second control means instantaneously lowers the level of said electric control current by said predetermined level when said purge control valve is closed immediately after said second control means instantaneously raises the level of said electric control current by said predetermined level.

10. An internal combustion engine according to claim 1, wherein said carburetor has an air bleed passage connected to said fuel passage, and said electric air-fuel ratio control valve is arranged in said air bleed passage to control the amount of air fed into said fuel passage from said air bleed passage in response to said electric control signal, said amount of air increasing as the level of said electric control signal rises.

11. An internal combustion engine according to claim 1, further comprising a throttle valve arranged in the intake passage, and an air supply passage open to the intake passage downstream of said throttle valve, wherein said electric air-fuel ratio control valve is arranged in said air supply passage to control the amount of air fed into the intake passage from said air supply passage in response to said electric control signal, said amount of air increasing as the level of said electric control signal rises.

* * * * *